US009342087B2

(12) United States Patent
Chen et al.

(10) Patent No.: US 9,342,087 B2
(45) Date of Patent: May 17, 2016

(54) VOLTAGE REGULATOR CIRCUIT

(71) Applicant: Faraday Technology Corp., Hsin-Chu (TW)

(72) Inventors: Chi-Yang Chen, Tainan (TW); San-Yueh Huang, Tainan (TW)

(73) Assignee: Faraday Technology Corp., Science-Based Industrial Park, Hsin-Chu (TW)

( * ) Notice: Subject to any disclaimer, the term of this patent is extended or adjusted under 35 U.S.C. 154(b) by 0 days.

(21) Appl. No.: 14/542,681

(22) Filed: Nov. 17, 2014

(65) Prior Publication Data

US 2016/0077535 A1 Mar. 17, 2016

(30) Foreign Application Priority Data

Sep. 11, 2014 (TW) ..... 103131326 A

(51) Int. Cl.
*G05F 1/00* (2006.01)
*G05F 1/575* (2006.01)
*G05F 1/56* (2006.01)

(52) U.S. Cl.
CPC . *G05F 1/575* (2013.01); *G05F 1/56* (2013.01)

(58) Field of Classification Search
CPC ..... G05F 1/57; G05F 1/56; G05F 1/573; G05F 1/575; G05F 3/30
USPC ..... 323/273–281, 313, 314
See application file for complete search history.

(56) References Cited

U.S. PATENT DOCUMENTS

| | | | | |
|---|---|---|---|---|
| 4,359,679 | A | 11/1982 | Regan | |
| 4,766,364 | A | 8/1988 | Biamonte et al. | |
| 5,883,797 | A | 3/1999 | Amaro et al. | |
| 7,421,593 | B2 | 9/2008 | Koertzen | |
| 7,642,759 | B2 | 1/2010 | Dobkin | |
| 2008/0191670 | A1 * | 8/2008 | Oddoart | G05F 1/565 323/273 |
| 2014/0160814 | A1 | 6/2014 | Morimoto et al. | |

FOREIGN PATENT DOCUMENTS

TW 200903970 1/2009

OTHER PUBLICATIONS

"Office Action of Taiwan Counterpart Application" , issued on Nov. 2, 2015, p. 1-p. 6.

* cited by examiner

*Primary Examiner* — Nguyen Tran
(74) *Attorney, Agent, or Firm* — Winston Hsu; Scott Margo

(57) ABSTRACT

A voltage regulator circuit is provided, which includes a main regulator and at least one auxiliary regulator. The main regulator provides an output voltage and regulates the output voltage according to the output voltage and a reference voltage. Each auxiliary regulator is coupled to the main regulator. Each auxiliary regulator also provides the output voltage and regulates the output voltage according to the output voltage and the reference voltage. Each of the main regulator and the at least one auxiliary regulator provides a branch current of the same magnitude. An output current of the voltage regulator circuit includes the branch currents provided by the main regulator and the at least one auxiliary regulator.

4 Claims, 2 Drawing Sheets

100

VOLTAGE REGULATOR CIRCUIT

CROSS-REFERENCE TO RELATED APPLICATION

This application claims the priority benefit of Taiwan application serial no. 103131326, filed on Sep. 11, 2014. The entirety of the above-mentioned patent application is hereby incorporated by reference herein and made a part of this specification.

BACKGROUND OF THE INVENTION

1. Field of the Invention

The invention relates to a voltage regulator circuit, and more particularly, relates to a voltage regulator circuit including a plurality of voltage regulators.

2. Description of Related Art

Voltage regulator circuits are found in virtually every integrated circuit. The voltage regulator circuit is capable of providing stable output voltage and maintaining a stability of the output voltage even if a large current is extracted.

Nonetheless, a current supplied by the voltage regulator circuit has its limit. If an output current is too large, reductions to the output voltage are inevitably. Also, the voltage regulator circuit is also prone to problem of overheating when the output current is too large.

SUMMARY OF THE INVENTION

The invention is directed to a voltage regulator circuit, capable of solving current problems and overheating problem of the traditional voltage regulator circuit.

A voltage regulator circuit of the invention includes a main regulator and at least one auxiliary regulator. The main regulator provides an output voltage and regulates the output voltage according to the output voltage and a reference voltage. Each auxiliary regulator is coupled to the main regulator. Each auxiliary regulator also provides the output voltage and regulates the output voltage according to the output voltage and the reference voltage. Each of the main regulator and the at least one auxiliary regulator provides a branch current of the same magnitude. An output current of the voltage regulator circuit includes the branch currents provided by the main regulator and the at least one auxiliary regulator.

Based on the above, the voltage regulator circuit of the invention utilizes the main regulator and the at least one auxiliary regulator to share the output current, so that the applications of high output current may be achieved, and the currents may be dispersed in order to reduce heat generation.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
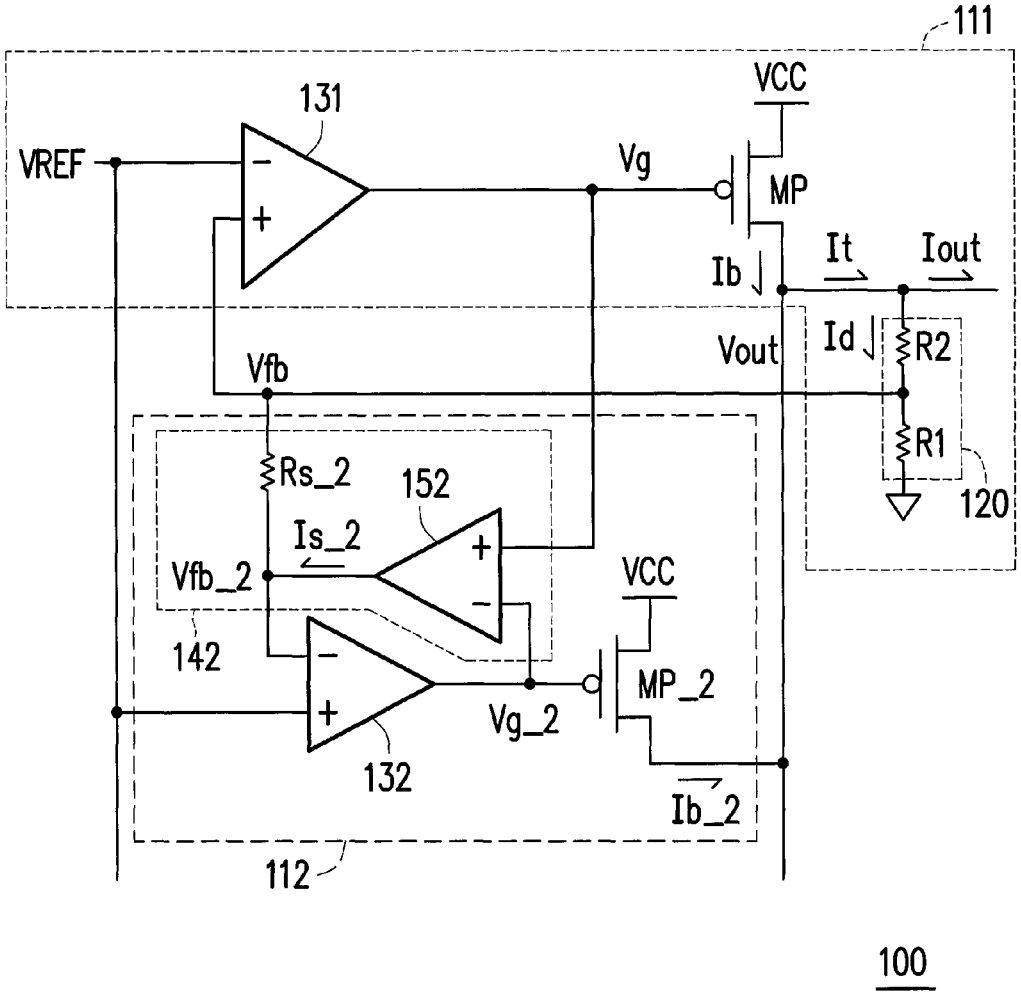
FIG. 1 is a schematic diagram of a voltage regulator circuit according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic diagram of a voltage regulator circuit 100 according to an embodiment of the invention. The voltage regulator circuit 100 is capable of providing a stable output voltage Vout. The voltage regulator circuit 100 includes a main regulator 111 and an auxiliary regulator 112. The auxiliary regulator 112 is coupled to the main regulator 111. The main regulator 111 includes an operational amplifier 131, a transistor MP and a voltage divider 120.

The voltage divider 120 is composed of resistors R1 and R2. The voltage divider 120 can provide a feedback voltage Vfb according to the output voltage Vout. The feedback voltage Vfb is a voltage division of the output voltage Vout. A non-inverting input terminal of the operational amplifier 131 receives the feedback voltage Vfb from the voltage divider 120. An inverting input terminal of the operational amplifier 131 receives a reference voltage VREF. An output terminal of the operational amplifier 131 is coupled to a gate of the transistor MP.

The transistor MP is a p-channel metal-oxide-semiconductor field-effect transistor. The transistor MP is coupled between a power voltage VCC and the voltage divider 120. The transistor MP is an output stage of the main regulator 111, and capable of providing a branch current Ib of the main regulator 111. The operational amplifier 131 amplifies an error between the feedback voltage Vfb and the reference voltage VREF to become a voltage Vg for regulating the branch current Ib through the gate of the transistor MP. The branch current Ib can affect the output voltage Vout. If the output voltage Vout is reduced, the voltage Vg is reduced accordingly. In this case, by increasing the branch current Ib correspondingly, the output voltage Vout may be pulled up. By contrast, if the output voltage Vout is increased, the voltage Vg is increased accordingly. In this case, by reducing the branch current Ib correspondingly, the output voltage Vout may be pulled down. By adopting a feedback mechanism as mentioned above, the main regulator 111 is capable of regulating the output voltage Vout according to the output voltage Vout and the reference voltage VREF.

The auxiliary regulator 112 includes an operational amplifier 132, a transistor MP_2 and a feedback unit 142. The feedback unit 142 includes a resistor Rs_2 and a transconductance operational amplifier 152. The transconductance operational amplifier 152 couples the gate of the transistor MP and a gate of the transistor MP_2 through a virtual short circuit. One terminal of the resistor Rs_2 is coupled to the feedback voltage Vfb from the voltage divider 120. Another terminal of the resistor Rs_2 is coupled to an output terminal of the transconductance operational amplifier 152 and an inverting input terminal of the operational amplifier 132. The resistor Rs_2 is capable of regulating the feedback voltage Vfb, and providing the regulated feedback voltage Vfb_2 to the inverting input terminal of the operational amplifier 132.

The inverting input terminal of the operational amplifier 132 receives the voltage Vfb_2. A non-inverting input terminal of the operational amplifier 132 receives the reference voltage VREF. An output terminal of the operational amplifier 132 is coupled to the gate of the transistor MP_2. The transistor MP_2 is also the p-channel metal-oxide-semiconductor field-effect transistor. The transistor MP_2 is coupled between the power voltage VCC and the voltage divider 120. The transistor MP_2 is an output stage of the auxiliary regulator 112, and capable of providing a branch current Ib_2 of the auxiliary regulator 112. The voltage divider 120, the operational amplifier 132 and the transistor MP_2 has a feedback mechanism similar to that of the main regulator 111. Therefore, the operational amplifier 132 is capable of regulating the branch current Ib_2 according to the feedback voltage Vfb and the reference voltage VREF, and the branch current Ib_2 can affect the output voltage Vout. Moreover, the auxiliary regulator 112 is also capable of regulating the output voltage Vout according to the output voltage Vout and the reference voltage VREF.

The branch current Ib of the main regulator 111 and the branch current Ib_2 of the auxiliary regulator 112 may be collected to become an output current It. A small part of the current It passes through the voltage divider 120 to generate the output voltage Vout at a junction of the transistors MP and MP_2 and the voltage divider 120. Therefore, the output voltage Vout is collaboratively provided by the main regulator 111 and the auxiliary regulator 112. A large part of the current It becomes an output current Iout in the end.

The auxiliary regulator 112 further includes the feedback unit 142 as a major difference from the main regulator 111. The transconductance operational amplifier 152 receives the gate voltage Vg of the transistor MP and a gate voltage Vg_2 of the transistor MP_2. The transconductance operational amplifier 152 amplifies a difference between the voltages Vg and Vg_2 to generate a current Is_2. Although FIG. 1 illustrates that a direction of the current Is_2 is an outflow from the transconductance operational amplifier 152, it is also possible that the direction of the current Is_2 is an inflow to the transconductance operational amplifier 152. The current Is_2 can be represented by the following equation: Is_2=Gm_2*(Vg−Vg_2), where Gm_2 is a gain of the transconductance operational amplifier 152. The current Is_2 passes through the resistor Rs_2 to generate the voltage Vfb_2, and therefore Vfb_2=Vfb+Is_2*Rs_2.

If the direction of the current Is_2 is the outflow from the transconductance operational amplifier 152, Vfb_2>Vfb, and this means that Vg>Vg_2. The virtual short circuit of the transconductance operational amplifier 152 can pull up the gate voltage Vg_2 of the transistor MP_2 to approximate the gate voltage Vg of the transistor MP.

Otherwise, if the direction of the current Is_2 is the inflow to the transconductance operational amplifier 152, Vfb_2<Vfb, and this means that Vg<Vg_2. The virtual short circuit of the transconductance operational amplifier 152 can pull down the gate voltage Vg_2 of the transistor MP_2 to approximate the gate voltage Vg of the transistor MP.

As mentioned above, the feedback unit 142 is capable of clamping the gate voltages of the transistors MP and MP_2, so that the gate voltage Vg_2 of the transistor MP_2 is equal to the gate voltage Vg of the transistor MP. Source voltages of both the transistors MP and MP_2 are VCC. Drains of the transistors MP and MP_2 are coupled to each other, such that drain voltages of the transistors MP and MP_2 are also equal to each other. Accordingly, if the transistors MP and MP_2 are made by using the same manufacturing process and parameters, the branch current Ib_2 of the auxiliary regulator 112 can be equal to the branch current Ib of the main regulator 111. Further, a feedback loop of the feedback unit 142 is capable of compensating a characteristic difference between the operational amplifiers 131 and 132, so that the branch current Ib_2 of the auxiliary regulator 112 can be equal to the branch current Ib of the main regulator 111.

Figure 2:
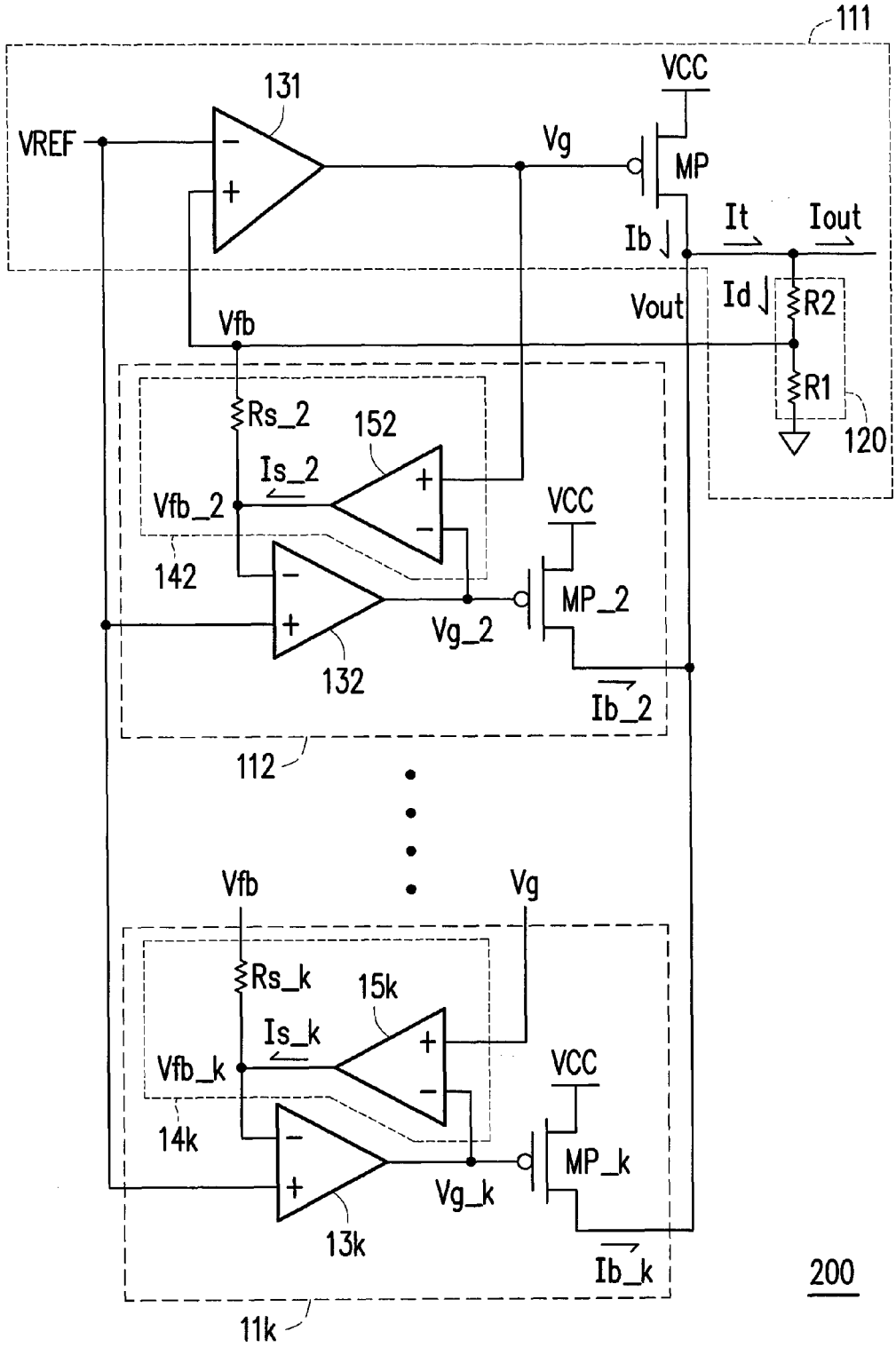
FIG. 2 is a schematic diagram of a voltage regulator circuit according to another embodiment of the invention.

FIG. 2 is a schematic diagram of a voltage regulator circuit 200 according to another embodiment of the invention. In the voltage regulator circuit 200, a plurality of auxiliary regulators 112 to 11*k* with the same structure are connected in parallel, where k can be an arbitrary integer that is greater than two. Each of the auxiliary regulators 112 to 11*k* has five common coupling points including a junction between the voltage divider 120 and the resistors R1 and R2 (corresponding to the feedback voltage Vfb), the gate of the transistor MP (corresponding to the voltage Vg), the reference voltage VREF, the power voltage VCC, and a junction between the transistor MP and the voltage divider 120 (corresponding to the output voltage Vout). The branch current Ib provided by the main regulator 111 and each of the branch currents Ib_2 to Ib_k respectively provided by auxiliary regulators 112 to 11*k* have the same magnitude. The branch currents Ib and Ib_2 to Ib_k may be collected to become the output current It. A small part of the current It passes through the voltage divider 120 to generate the output voltage Vout. A large part of the current It becomes the output current Iout in the end.

In summary, the voltage regulator circuit of the invention includes a plurality of voltage regulators, and each of the voltage regulators is capable of providing the same current. Accordingly, the voltage regulators can be used to collaboratively promote for applications of high output current. Alternatively, the voltage regulators can also be distributively disposed in different areas of the integrated circuit to disperse the currents, so as to reduce heat generation in order to avoid overheating.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage regulator circuit, comprising:

a main regulator, providing an output voltage, and regulating the output voltage according to the output voltage and a reference voltage, the main regulator comprises:

a voltage divider, providing a feedback voltage according to the output voltage, wherein the feedback voltage is a voltage division of the output voltage;

a first transistor, coupled between a power voltage and the voltage divider, and providing a branch current of the main regulator, wherein a junction of the first transistor and the voltage divider provides the output voltage; and a first operational amplifier, coupled to the voltage divider and the first transistor, and regulating the branch current of the main regulator according to the feedback voltage and the reference voltage; and at least one auxiliary regulator, coupled to the main regulator, providing the output voltage, and regulating the output voltage according to the output voltage and the reference voltage, wherein each of the main regulator and the at least one auxiliary regulator provides the branch current of a same magnitude, and an output current of the voltage regulator circuit comprises the branch currents provided by the main regulator and the at least one auxiliary regulator, wherein each of the at least one auxiliary regulator comprises:

a second transistor, coupled between the power voltage and the voltage divider, and providing the branch current of the corresponding auxiliary regulator;

a second operational amplifier, coupled to the second transistor, and regulating the branch current of the corresponding auxiliary regulator according to the feedback voltage and the reference voltage; and a feedback unit, coupling the gate of the first transistor and a gate of the second transistor through a virtual short circuit, and coupled to the voltage divider and the second operational amplifier, and regulating the feedback voltage and providing the regulated feedback voltage to the second operational amplifier.

2. The voltage regulator circuit of claim 1, wherein a non-inverting input terminal of the first operational amplifier receives the feedback voltage, an inverting input terminal of the first operational amplifier receives the reference voltage, and an output terminal of the first operational amplifier is coupled to a gate of the first transistor.

3. The voltage regulator circuit of claim 1, wherein an inverting input terminal of the second operational amplifier receives the regulated feedback voltage, a non-inverting input terminal of the second operational amplifier receives the reference voltage, and an output terminal of the second operational amplifier is coupled to the gate of the second transistor.

4. The voltage regulator circuit of claim 1, wherein the feedback unit comprises:

a transconductance operational amplifier, coupling the gate of the first transistor and the gate of the second transistor through the virtual short circuit; and a resistor, wherein one terminal of the resistor is coupled to the feedback voltage, and another terminal of the resistor is coupled to an output terminal of the transconductance operational amplifier and an inverting input terminal of the second operational amplifier.

* * * * *